US007832150B1

(12) United States Patent
Pratt

(10) Patent No.: US 7,832,150 B1
(45) Date of Patent: Nov. 16, 2010

(54) BASEMENT WATER DRAINAGE DEVICE

(76) Inventor: James M. Pratt, P. O. Box 920624, Needham, MA (US) 02492

( * ) Notice: Subject to any disclaimer, the term of this patent is extended or adjusted under 35 U.S.C. 154(b) by 0 days.

(21) Appl. No.: 12/231,850

(22) Filed: Sep. 8, 2008

Related U.S. Application Data

(63) Continuation-in-part of application No. 11/378,774, filed on Mar. 20, 2006.

(51) Int. Cl.
*E04D 13/14* (2006.01)

(52) U.S. Cl. ..... 52/61; 52/97; 52/169.5; 52/302.6; 52/716.2

(58) Field of Classification Search ..... 52/61, 52/62, 169.5, 58, 60, 302.1, 602.3, 302.6, 52/716.2, 97, 219, 200
See application file for complete search history.

(56) References Cited

U.S. PATENT DOCUMENTS 3,283,460 A * 11/1966 Patrick ..... 52/274
4,245,443 A * 1/1981 Beechen ..... 52/169.5
4,745,716 A * 5/1988 Kuypers ..... 52/169.5
4,869,032 A * 9/1989 Geske ..... 52/169.5
5,771,643 A * 6/1998 Parker ..... 52/169.5
5,784,838 A * 7/1998 Phillips ..... 52/169.5
6,241,421 B1 * 6/2001 Harvie et al. ..... 405/45
6,672,016 B2 * 1/2004 Janesky ..... 52/169.5
2007/0214738 A1 * 9/2007 Koessler ..... 52/302.6

* cited by examiner

*Primary Examiner*—Richard E Chilcot, Jr.
*Assistant Examiner*—William V Gilbert
(74) *Attorney, Agent, or Firm*—William Nitkin

(57) ABSTRACT

An L-shaped water seepage control device having a wall panel positioned vertically against the interior of a foundation wall and a base member extending horizontally from the bottom of the wall panel over a foundation footing, such wall panel and base member having a plurality of elongated U-shaped formations extending inwardly downward along the wall panel and horizontally along the base member with the bottoms of such U-shaped formations positioned against the foundation wall and resting on the top of the foundation footing and forming a plurality of drain channels therebetween for directing water passing down and through the interior foundation wall to pass through the drain channels and over the end of the foundation footing to a water-collecting area.

15 Claims, 3 Drawing Sheets

BASEMENT WATER DRAINAGE DEVICE

This application is a continuation-in-part of my prior application entitled Water Drainage System, Ser. No. 11/378,774, filed Mar. 20, 2006, now pending

BACKGROUND OF THE INVENTION

1. Field of the Invention

The device of this invention resides in the area of basement water seepage control devices for directing and channeling water into water drainage conduits and more particularly relates to an L-shaped device that is positioned against the inside foundation wall and on the foundation footing, such device having channels therein for directing water seepage to a drainage conduit disposed at the end of the foundation footing or into the gravel at the end of the foundation footing.

2. History of the Prior Art

There are many water drainage devices for positioning adjacent to a basement foundation and rest upon the foundation footing. Some of such devices are disclosed in the following U.S. patents: U.S. Pat. No. 3,283,460 to Patrick; U.S. Pat. No. 4,245,443 to Beechen; U.S. Pat. No. 4,745,716 to Kuypers; U.S. Pat. No. 4,869,032 to Geske; U.S. Pat. No. 5,771,643 to Parker; U.S. Pat. No. 5,784,838 to Phillips; U.S. Pat. No. 6,241,421 to Harvie et al; and U.S. Pat. No. 6,672,016 to Janesky.

Typical of the above water drainage devices is U.S. Pat. No. 3,283,460 to Patrick which teaches the use of an L-shaped member having a plurality of channels formed in its bottom. The L-shaped member, which fits against the foundation wall and rests upon the foundation footing, has a plurality of elongated channels extending down the portion of the device positioned against the foundation wall which elongated channels then extend down thereunder into the portion of the L-shaped member resting upon the foundation footing to direct the water under the foundation floor to a gravel bed through which a drainage pipe can extend and receive the water that has passed through such gravel. U.S. Pat. No. 6,672,016 to Janesky teaches an improvement of this subfloor L-shaped drainage device by providing a plastic panel having a plurality of frustoconical protrusions which space the panel away from the foundation wall and the foundation footing so that water can pass therebehind and thereunder to a drainage pipe that is provided within the gravel field under the basement floor or into the gravel itself.

SUMMARY OF THE INVENTION

It is an object of this invention to provide an improved water drainage device comprised of a vertical wall panel and a horizontally disposed base member which form an L-shape. The vertical wall panel has elongated channels of square wave form cross-section adapted to be positioned against the inside foundation wall and has a lip at the top of the vertical wall panel extending therefrom at a 45-degree angle away from the foundation wall to catch any water that drips from the foundation wall to cause it to pass behind the vertical wall panel and under the horizontally disposed base member extending from the bottom of the vertical wall panel to water-collecting means located at the end of the foundation footing. A plurality of drain channels having a square wave form cross-section are formed beneath the base member by a plurality of open, continuous, generally U-shaped formations, each extending inward from the wall panel and down from the base member, such U-shaped formations being elongated and parallel to one another and perpendicular to the length of the water drainage device. Water seeping through the foundation wall or under the foundation wall and over the foundation footing is first directed behind the vertical wall panel and then passes under the base member through the plurality of drain channels formed between the base member and the foundation footing to be received by the water-collecting means, such as a drainage conduit, disposed below the floor at the end of the foundation footing or gravel or stone disposed at the end of the foundation footing under the floor which water collecting means are well known.

DESCRIPTION OF THE PREFERRED EMBODIMENT(S)

Figure 1:
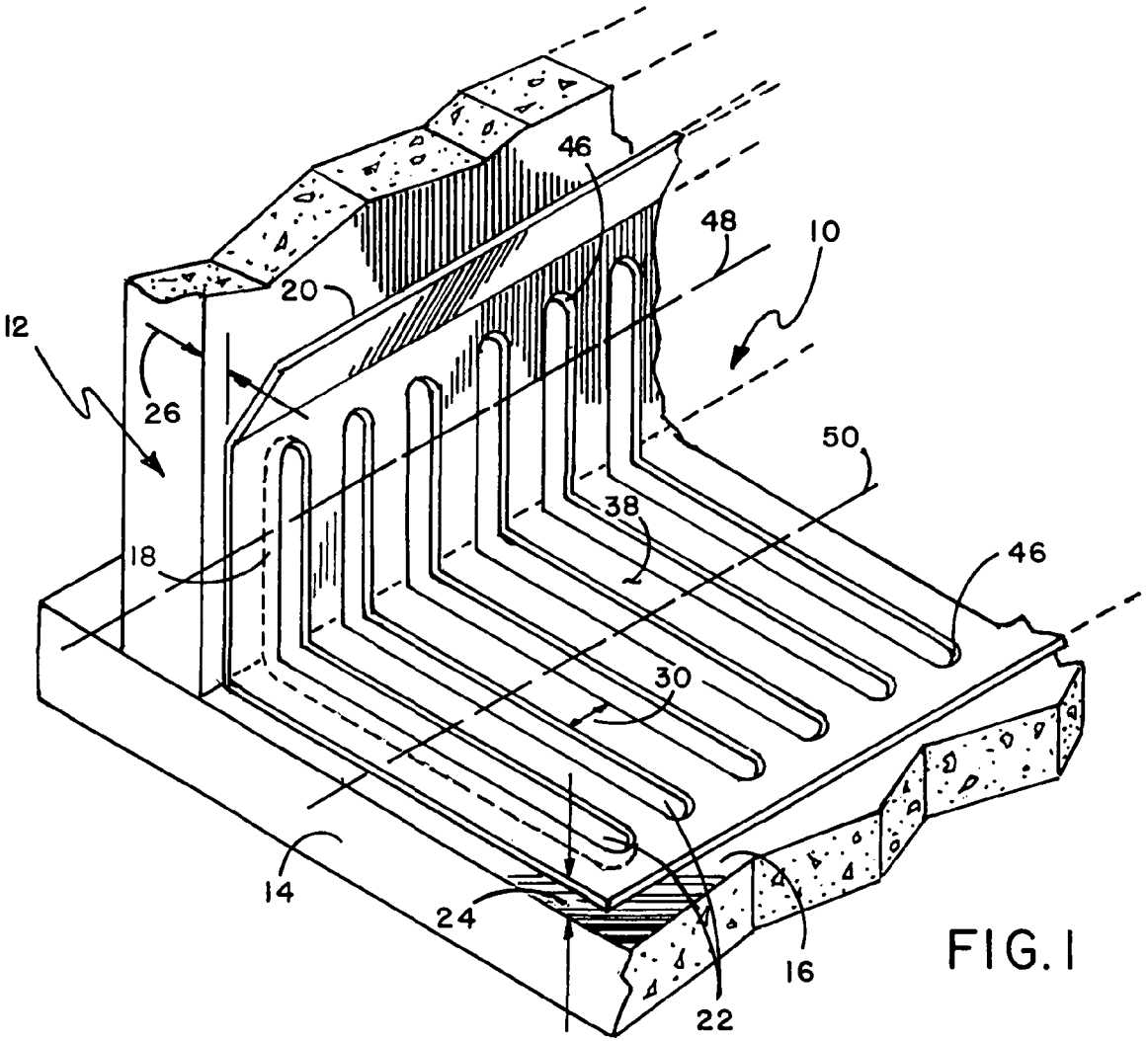
FIG. 1 illustrates a perspective sectional view of the L-shaped device of this invention installed against the inside of a foundation wall above the foundation footing.
Figure 3:
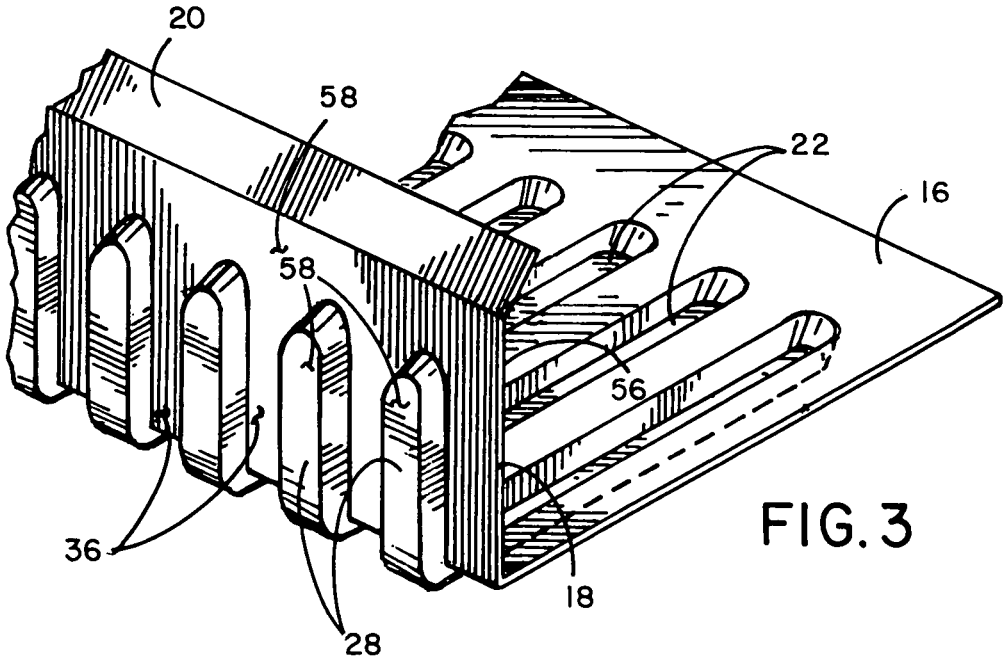
FIG. 3 illustrates a rear sectional perspective view of the device of this invention.

FIG. 1 illustrates a perspective sectional cutaway view of L-shaped device 10 of this invention positioned against foundation wall 12 and resting upon foundation footing 14. L-shaped device 10 is comprised of a vertically disposed wall panel 18 and horizontally disposed base member 16. Wall panel 18 has a top 52, a bottom 54, a first plane 46, an inner first side 56 and an outer second side 58. Outer second side 58 of wall panel 18 is positioned vertically against the interior of foundation wall 12 with base member 16 extending horizontally at approximately a 90-degree angle from inner first side 56 of wall panel 18 at the bottom thereof with base member 16 having a second plane 50. Wall panel 18 is disposed with its U-shaped formations 28 having sides disposed perpendicular to its bottom, such sides being formed at right angles therewith, as best seen in FIG. 3, and the bottoms 22 of U-shaped formations 28 are positioned against the inside of foundation wall 12. A narrow lip 20, as also seen in FIG. 3, extends along the top of wall panel 18 inwardly and upwardly at approximately a 45-degree angle which lip helps direct water falling down from foundation wall 12 so that the water will pass behind wall panel 18 and not reach cement floor 40. The water passing down behind vertical wall panel 18 is then directed through a plurality of channels 36 formed between the plurality of elongated, U-shaped formations 28 which protrude inward from wall panel 18 and also extend downward from base member 16. Any other water that might pass over foundation footing 14 under foundation wall 12 will also pass through channels 36. In a preferred embodiment the plurality of U-shaped formations 28 can be disposed parallel to one another with their sides 34 extending downward approximately ⅜-½ inch.

When the device of this invention is installed, base member 16 can be covered first by concrete or gravel and then by a cement floor up as far as to the level of lip 20. Thus, when installed, base member 16 has a height 26 of approximately ⅜ inch above the top of foundation footing 14 such that water can easily pass from behind wall panel 18 through channels 36, each of which has a height 42; and through channels 36 of base member 16, as seen in FIG. 4, located above top 40 of foundation footing 14 to an area, not shown, under a cement floor where the water will pass through the ground to a water-collecting means such as drain conduit having apertures therein to allow water to pass therein for redirection to a water collection means, such as a sump pump and the like which conduit and water collection means are well known in the art.

In a preferred embodiment the device of this invention can be made of plastic. The elongated, U-shaped formations 28 formed as part of wall panel 18 and base member 16 of the device of this invention add structural strength to the device and make for a very sturdy and economical basement water drainage device providing ample drain channels. Water is easily directed through drain channels 36 since the contact of bottoms 22 of channels 36 against foundation wall 12 causes the water to flow within drain channels 36, thereby concentrating the water flow into such channels to increase its volume and hence its rate of flow.

Figure 2:
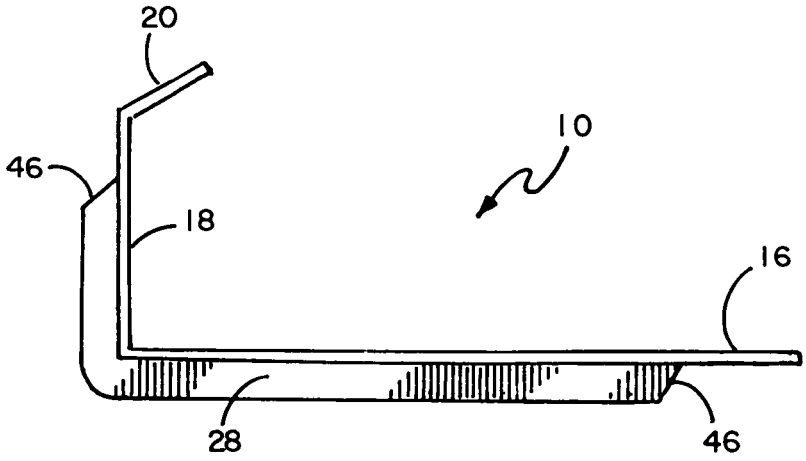
FIG. 2 illustrates a side view of the device of this invention.
Figure 4:
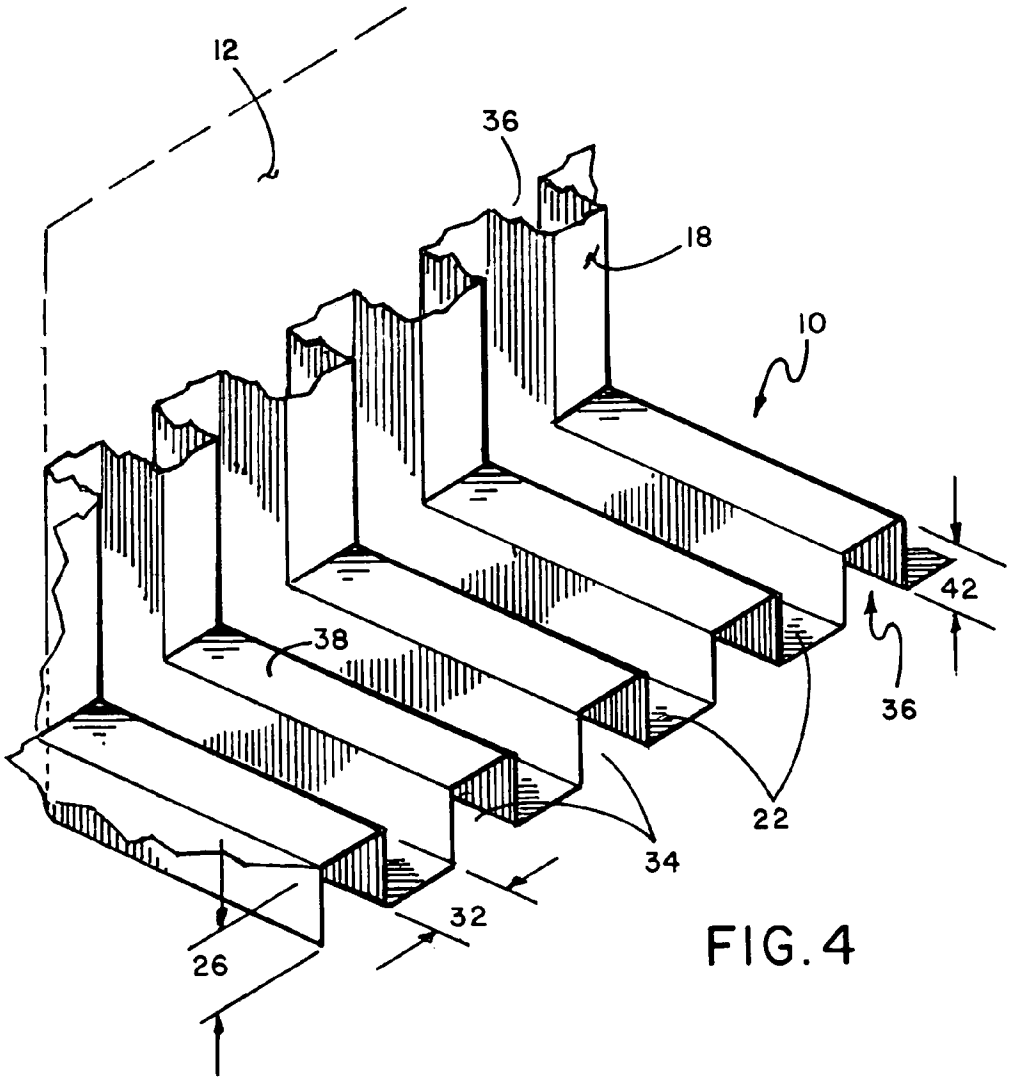
FIG. 4 illustrates a front sectional view of the channels of the device of this invention.

FIG. 4 illustrates a front sectional view of the device of this invention. Channels 36 within wall panel 18 and base member 16 can be formed by a plastic molding process, such channels in the base member having generally vertical channel sides 34 and channel top 38, creating an open square wave shape, as seen in FIG. 4, which illustrates a cutaway view of a section of FIG. 1 cut through plane 48 and second plane 50. The bottoms 22 of the U-shaped formations between each channel form flat contact points 22 which rest both against foundation wall 12 and on foundation footing 14 forming water movement channels 36 therebetween, such channels having channel tops 38. In the molding process the channels are formed with vertically disposed channel sides 34 but can have a slight angle 46 in their formation at each end, as seen in FIGS. 2 and 4. By having the plurality of channels formed in a square wave shape in cross section in the device of this invention extending from foundation wall 12 to along the top 40 of foundation footing 14, it has been found that water seepage better accumulates in greater quantities as it is blocked from movement by flat contact points 22 against foundation footing 14 and foundation wall 12 and is thus directed in a greater quantity into channels 36, causing the water to drop and move faster to be ultimately directed to water collection means. Having the plurality of channels formed in a square wave shape in cross section in the device of this invention is critical to the advantages and performance of the device. Each channel is generally evenly spaced apart from its adjacent channel by a distance 30 which distance can be equal to the width 32 of the each U-shaped formation, thus providing for a faster water pass-through. Further, the U-shaped formations 28 disposed in parallel array receive the floor's concrete, and U-shaped formations 28 have been found to adhere better to concrete to form a more structurally sound edging wherein the concrete from the floor tends to pressure the flat contact points 22 laterally and downward with greater force against foundation wall 12 and foundation footing 14 so as to eliminate water movement under such contact points 22 to better direct the water into channels 36. Increased volume creates a better water flow that moves through the device of this invention rather than an overall dampness which might tend to remain in place when using prior art structures.

Although the present invention has been described with reference to particular embodiments, it will be apparent to those skilled in the art that variations and modifications can be substituted therefor without departing from the principles and spirit of the invention.

I claim:

1. A device for directing water to a water collector located along a foundation footing, the device adapted to be installed adjacent to the interior of a basement foundation wall and on top of a foundation footing, comprising:

a wall panel lying in a first plane and having a top edge, a bottom, and front and rear surfaces, said rear surface of said wall panel being adapted to overlie a portion of the foundation wall;

a base member extending from the bottom of said wall panel at approximately a right angle and including a substantially planar top surface lying in a second plane and a substantially planar bottom surface, said bottom surface of said base member being substantially parallel to said top surface and adapted to overlie a portion of the foundation footing;

a portion of said wall panel along said top edge between said first side and second side being bent away from said first plane and toward said base member to form a lip;

said base member top surface including a plurality of substantially uninterrupted U-shaped channels formed therein, each of said U-shaped channels projecting from the base member bottom surface and including a channel bottom and being adapted to support the device on the foundation footing and to define with the foundation footing a plurality of drain channels between adjacent ones of said U-shaped channels for directing water from the foundation wall along the foundation footing toward the water collector; and wherein said base member U-shaped channels have a first end at said wall panel and a closed end between said wall panel and an end edge of said base member, said closed end having an upper surface in substantially the same plane as said top surface.

2. The device of claim 1 wherein said top surface extends between adjacent pairs of said plurality of U-shaped channels.

3. The device of claim 1 wherein said wall panel includes a plurality of U-shaped channels in communication with said base member U-shaped channels, said U-shaped channels of said wall panel including a channel bottom projecting from the wall panel rear surface.

4. The device of claim 1 wherein said base member U-shaped channels have a first end at said wall panel and a closed end spaced from said wall panel.

5. The device of claim 4 wherein said wall panel U-shaped channels have a first end at said base member and a closed end between said base member and said lip.

6. The device of claim 4 wherein said wall panel U-shaped channels have a first end at said base member and a closed end spaced from said base member.

7. The device of claim 6 wherein said wall panel includes a continuous planar strip portion between the closed ends of said wall panel U-shaped members and said lip.

8. The device of claim 6 wherein said base member includes an end edge spaced from said wall member and wherein said base member includes a continuous planar strip between said closed ends of said base member U-shaped channels and said base member end edge.

9. The device of claim 1 wherein said U-shaped channel bottoms each include a planar bottom portion parallel to said second plane.

10. A device for directing water to a water collector located along a foundation footing, the device adapted to be installed adjacent to the interior of a basement foundation wall and on top of a foundation footing, comprising:

a wall panel lying in a first plane and having a top edge, a bottom, and front and rear surfaces, said rear surface of said wall panel being adapted to overlie a portion of the foundation wall;

a base member extending from the bottom of said wall panel at approximately a right angle and including a top surface lying in a second plane and a bottom surface adapted to overlie a portion of the foundation footing and having an end edge spaced from said wall panel;

a portion of said wall panel along said top edge between said first side and second side being bent away from said first plane and toward said base member to form a lip; and said base member top surface including a plurality of U-shaped channels formed therein, each of said U-shaped channels projecting from the base member bottom surface and including a closed end between said base member end edge and said wall panel and having a channel bottom and being adapted to support the device on the foundation footing and to define with the foundation footing a plurality of drain channels between adjacent ones of said U-shaped channels for directing water from the foundation wall along the foundation footing toward the water collector, wherein said base member includes a continuous planar strip portion between said U-shaped channel closed ends and said end edge of said base member, said continuous planar strip having a surface in substantially the same plane said second plane.

11. The device of claim 10 wherein said wall panel includes a plurality of U-shaped channels in communication with said base member U-shaped channels, said U-shaped channels of said wall panel including a channel bottom projecting from the wall panel rear surface.

12. The device of claim 11 wherein said wall panel U-shaped channels have a first end at said base member and a closed end spaced from said base member.

13. The device of claim 11 wherein said wall panel U-shaped channels have a first end at said base member and a closed end between said base member and said lip.

14. The device of claim 11 wherein said wall panel includes a continuous planar strip portion between the closed ends of said wall panel U-shaped channels and said lip.

15. The device of claim 10 wherein said continuous planar strip lies in said second plane.

* * * * *